United States Patent [19]

Artz et al.

[11] Patent Number: 4,502,526

[45] Date of Patent: Mar. 5, 1985

[54] SEAL FOR A CONTINUOUS STEEL CASTER

[75] Inventors: Gerd Artz, Ratingen; Dieter Figge; Thomas Hoster, both of Essen; Clemens Philipp, Meerbusch, all of Fed. Rep. of Germany

[73] Assignee: FRIED. KRUPP Gesellschaft mit beschränkter Haftung, Essen, Fed. Rep. of Germany

[21] Appl. No.: 515,639

[22] Filed: Jul. 20, 1983

[30] Foreign Application Priority Data

Aug. 23, 1982 [DE] Fed. Rep. of Germany ..... 3231321

[51] Int. Cl.[3] ..... B22D 11/06; B22D 11/10

[52] U.S. Cl. ..... 164/415; 164/432; 164/434; 164/440

[58] Field of Search ..... 164/430–432, 164/415, 437, 440, 475, 481, 488–490, 434

[56] References Cited

U.S. PATENT DOCUMENTS

| | | | |
|---|---|---|---|
| 3,598,173 | 8/1971 | Dore et al. | 164/444 X |
| 3,774,670 | 11/1973 | Gyongyos | 164/430 |
| 3,857,437 | 12/1974 | Watts | 164/440 X |
| 3,905,418 | 9/1975 | Watts | 164/440 X |
| 4,217,947 | 8/1980 | Gyongyos et al. | 164/437 X |

FOREIGN PATENT DOCUMENTS

| | | | |
|---|---|---|---|
| 71802 | 2/1983 | European Pat. Off. . | |
| 2652732 | 6/1977 | Fed. Rep. of Germany . | |
| 2919880 | 11/1980 | Fed. Rep. of Germany . | |
| 51-18927 | 2/1976 | Japan | 164/437 |
| 57-4358 | 1/1982 | Japan | 164/430 |
| 57-88952 | 6/1982 | Japan | 164/440 |
| 570835 | 12/1975 | Switzerland . | |

*Primary Examiner*—Nicholas P. Godici
*Assistant Examiner*—J. Reed Batten, Jr.
*Attorney, Agent, or Firm*—Spencer & Frank

[57] ABSTRACT

A continuous steel casting apparatus includes a casting nozzle, a mold surrounding the casting nozzle and having moving mold walls together defining a rectangular casting cross section and being formed of oppositely located, parallel-extending endless casting belts and oppositely located, parallel-extending endless lateral dams. A sealing assembly provides a seal between the casting nozzle and the mold walls. The sealing assembly includes sealing levers situated between the casting nozzle and the casting belts. The sealing levers are movably mounted on the casting nozzle. Each sealing lever has a sealing face oriented towards a respective casting belt and extending parallel to the width thereof. Further, each sealing lever is resiliently urged into a sealing engagement with the casting belts. Side surfaces of the sealing levers sealingly engage the dams.

11 Claims, 5 Drawing Figures

SEAL FOR A CONTINUOUS STEEL CASTER

BACKGROUND OF THE INVENTION

This invention relates to a casting nozzle and a continuous steel casting mold surrounding the nozzle. The mold has a rectangular casting cross section and includes pairwise oppositely located endless casting belts and articulated endless dams arranged laterally along the casting belts. In particular, the invention is concerned with a seal between the casting nozzle and the continuous steel casting mold.

Continuous casting molds of the above-outlined type to which the molten metal is admitted in an open trough permit the continuous casting of lead, zinc and copper with high casting speeds. The air intake which necessarily occurs because of the use of the open trough does not adversely affect the casting operation and the quality of the cast products.

In contradistinction, in the steel casting there are used preferably vertically oriented oscillating molds whose molten metal level is covered by casting powder to prevent the admission of air. The steel melt is admitted from a distributor vessel into a vertically oriented submersion pipe which has outlet openings below the level of the melt. Because of the use of an oscillating mold, the casting speed of such a known process and that of the associated casting apparatus is limited to approximately 3 to 4 m/min.

Higher casting speeds of at least 10 m/min in steel casting may be materialized only with continuous casting molds which, like those mentioned earlier, have mold walls constituted by endless casting belts moved in the direction of casting and further have articulated lateral dams. Since the casting cross section is rectangular, a mutual sealing of the four cooperating mold walls is very difficult. Further, with regard to the quality of the cast product, care has to be taken by means of an appropriate design of the casting nozzle that no air is introduced into the continuous casting mold.

A satisfactorily functioning seal between the moving mold walls and the adjustable, but operationally stationary casting nozzle for separating the steel melt from air has not been developed heretofore. The provision of a satisfactory seal has also been made difficult by the fact that because of the liquid steel column in the distributor vessel, the seal has to be effective against a pressure of 0.5 bar. Further, after a certain period of service, the casting belts develop a wavy configuration which also has to be taken into account when designing the sealing elements. In addition, in any solution for a seal, the limited spatial conditions have to be considered which arise because of the relatively small cross-sectional area (normally in the order of magnitude of 80×170 mm) of the casting cross section.

SUMMARY OF THE INVENTION

It is an object of the invention to provide, for a continuous steel casting mold having moving mold walls, a seal assembly which takes into account the earlier-discussed difficulties and operates in a satisfactory manner throughout a sufficiently large service period.

This object and others to become apparent as the specification progresses, are accomplished by the invention, according to which, briefly stated, at least one sealing lever resiliently and sealingly engages each casting belt along its width measured transversely to the length (axial dimension) of the casting nozzle. Each sealing lever has opposite lateral surfaces oriented towards and being in sealing engagement with the lateral dams. Each sealing lever is movably mounted on the casting nozzle.

Thus, for ensuring a seal between the casting nozzle and the endless casting belts of the continuous casting mold, the invention basically provides at least one sealing lever which engages the casting belts with a spring force. In order to ensure that this mechanically functioning seal is adapted to a certain waviness of the casting belts in an improved manner, normally a plurality of relatively movable sealing levers are arranged side-by-side, as viewed in a direction transverse to the length of the casting nozzle.

The outer lateral surface of each sealing lever, oriented towards the lateral dams, is so structured that it constitutes a lateral sealing element sealingly engaging the lateral dams. Thus, each casting belt is, at its inner face oriented towards the casting nozzle sealed along its entire width between the opposite dams by means of the sealing lever or sealing levers. The use of a pivotally supported sealing lever as lateral sealing element also means that the sealing lever is supported for motions transversely to the length dimension of the casting nozzle as well. In case a plurality of side-by-side arranged sealing levers are used, transversal spring elements in engagement with the sealing levers may be used to effect a certain mutual alignment and engagement with the dam blocks.

According to a further feature of the invention, which results in a particularly advantageous and effective design of the sealing lever, the latter is provided with a cylindrical part which is pivotally supported on the casting nozzle in a cylindrical, cradle-like bearing. The provision of the cylindrical pivotal part as connecting element simultaneously ensures that the sealing lever may also shift laterally, that is, parallel to the axis of the cylindrical part.

According to another further feature of the invention, the sealing lever has a resiliently supported setting arm and at least one sealing edge which is maintained in engagement on the casting belt by means of the spring-biased setting arm. The setting arm is expediently situated in front of (upstream of) the pivotal support of the sealing lever, as viewed in the casting direction. If required, the sealing lever may be provided with a plurality of sealing edges arranged in a series in the casting direction.

According to still another feature of the invention, the space which is situated between the setting arm and the casting nozzle and which accommodates the spring element supporting the setting arm, is sealed from the environment. Because of the high environmental temperatures, which are approximately between 1300° and 1500° C., the spring element has to be made of a highly heat-resistant special material such as tungsten. This requires that the chamber receiving the spring element contain an inert gas as a protective gas to prevent admission of air. Such a gas is admitted to the chamber by a supply conduit. The seal for the chamber may be formed by a sealing plate mounted on the setting arm and engaging slidably a counter face of the casting nozzle.

In order to be able to collect steel melt behind the sealing edge of the sealing levers in case of malfunctioning, according to a further feature of the invention, the space upstream of the sealing edge (as viewed in the direction of casting) between the casting belt and the casting nozzle, is filled with a layer which comprises steel melt-resistant granular material, particularly magnesium oxide. The thickness of the granulated material layer in the direction of the length of the casting nozzle is sufficient to surround the sealing lever or sealing levers. The diameter of the individual granules is sufficiently large so as to be prevented from gaining access to the zone behind the sealing levers as the mold walls move.

In case a plurality of side-by-side arranged sealing levers are used, the clearance therebetween may be sealed by a yielding sealing material, such as sealing cords made of a ceramic fiber material, supported between the sealing levers. It is further feasible to charge the space situated upstream of the sealing edges (as viewed in the direction of casting) with a protective gas such as an inert gas or use the above-described mechanical and gas sealing means in combination. The use of a protective gas is particularly expedient if the same is required in any event, for example, for screening the spring element of the sealing lever.

In case the side-by-side arranged sealing levers are so designed and arranged with respect to one another that the clearance between them does not exceed 0.2 mm, additional sealing means may be omitted. This applies in case of steel casting if the steel is not superheated in excess of 80° C. It is to be understood that the earlier-explained measures for sealing the sealing levers with respect to one another may be effected even if the clearance does not exceed 0.2 mm.

According to another feature of the invention, for providing a seal between the casting nozzle and the lateral dams, sealing strips are used which are supported on the casting nozzle and resiliently engage the dam blocks. In such a preferred embodiment the seal thus is formed essentially of mechanically functioning sealing elements wherein the sealing levers engage, with their sealing edges, the casting belts and, on the other hand, the sealing levers and the sealing strips, extending to the zone of the sealing levers, engage the lateral dams. The highly satisfactory sealing effect of the sealing strips is ensured by providing that they form a seal with the sealing levers. This may be effected—in case the sealing lever is supported by means of a cylindrical pivotal portion on the casting nozzle—by providing that those end portions of the sealing strips which are oriented towards the sealing levers have a recessed part which conforms to and accommodates the pivotal part. The cylindrical pivotal part of the outer sealing lever is thus supported, on the one hand, in the cradle-like bearing on the casting nozzle and, on the other hand, in the recessed part of the sealing strip which is movable with respect to the cast body.

The sealing levers which may be formed of several components are made, similarly to the sealing strips and the casting nozzle, preferably of a ceramic material having at least approximately uniform coefficients of heat expansion. The resilient support of the sealing strips on the casting nozzle is effected by means of spring elements which are made preferably of tungsten and which are, if required, disposed in a chamber filled with a protective (inert) gas.

DESCRIPTION OF THE PREFERRED EMBODIMENTS

Figure 1:
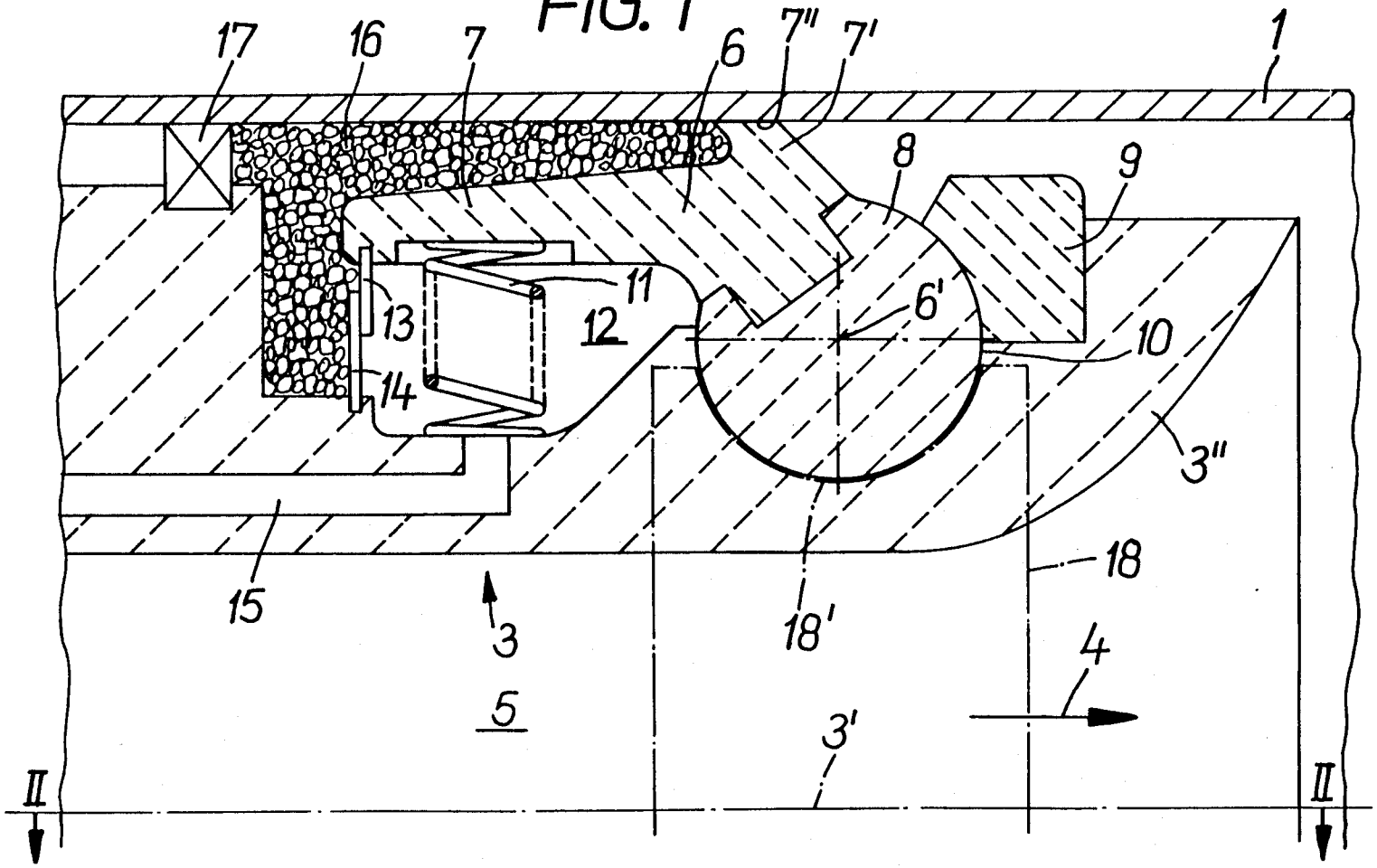
FIG. 1 is an axial sectional view of one symmetrical half of a preferred embodiment of the invention.
Figure 2:
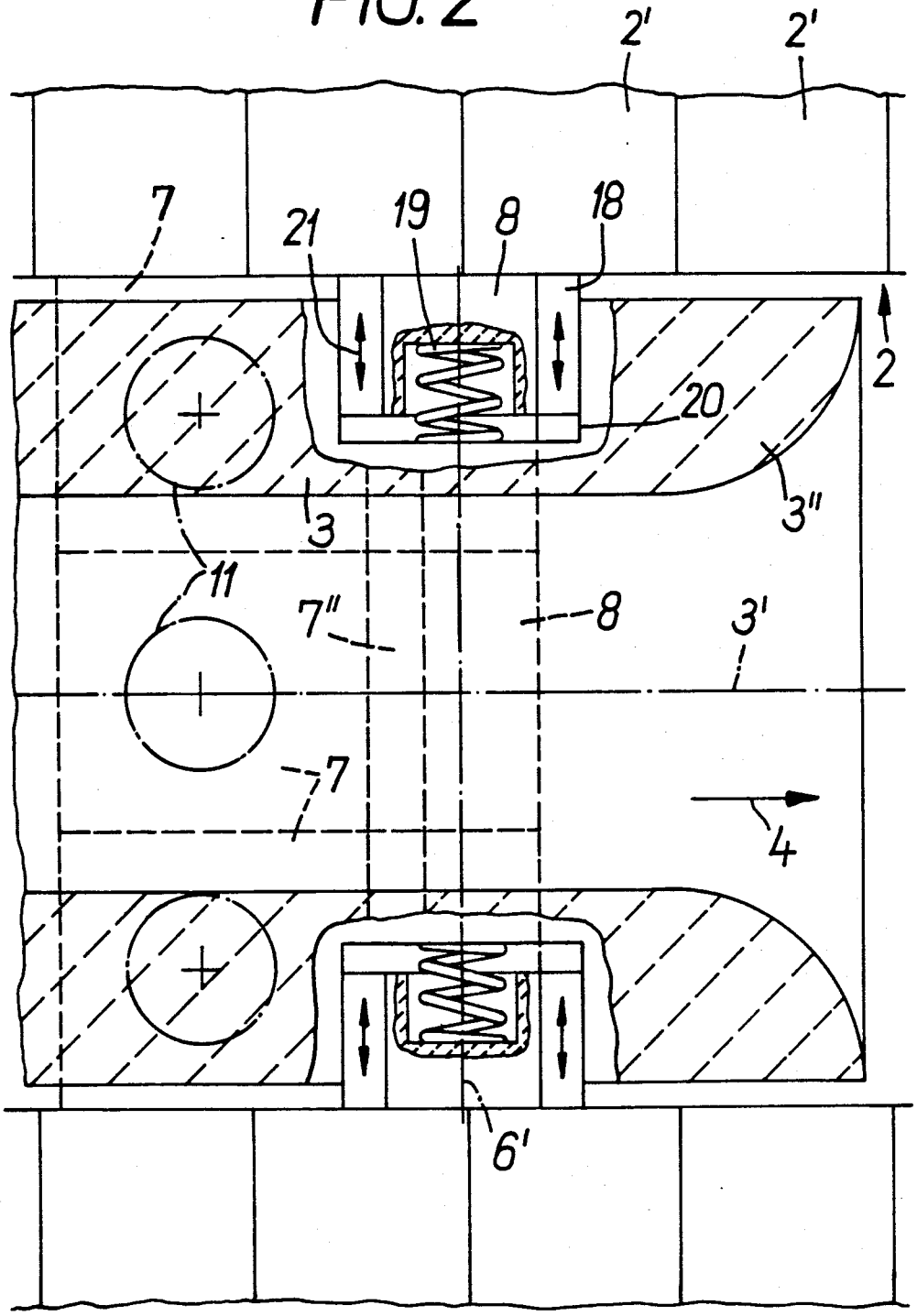
FIG. 2 is a sectional view, on a reduced scale, taken along line II—II of FIG. 1.

Turning now to FIGS. 1 and 2, the continuous steel casting mold shown therein comprises, as essential components, two endless casting belts 1 (only one shown in FIG. 1) and two endless articulated lateral dams 2 formed of dam blocks 2′ movable relative to one another. The casting belts 1 and the lateral dams 2 are arranged diametrically oppositely with respect to the longitudinal axis 3′ of a ceramic casting nozzle 3 to thus define a rectangular casting cross section downstream of the casting nozzle 3 as viewed in the casting direction indicated by the arrow 4. The lateral dams 2 which serve as vertical mold walls thus adjoin sealingly the casting belts 1 which serve as horizontal mold walls. Both casting belts 1 and both dams 2 are trained about horizontal end rolls (not shown) and move in the zone of the casting nozzle 3 and the casting cross section during the casting process in the casting direction 4.

The casting nozzle 3 which is coupled to a distributing vessel (not shown) is of rectangular tubular design and has a casting bore 5 which, at the downstream end of the nozzle (as viewed in the direction of casting) flares outwardly in a frontal nozzle portion 3″. The casting nozzle 3 is maintained stationary with respect to the mold walls 1 and 2 at least during the casting procedure and has normally a plurality of components.

For sealing the intermediate space between the moving casting belts 1 to prevent steel melt from being introduced from the right (as viewed in FIGS. 1 and 2), on the frontal part 3″ of the casting nozzle 3 there are mounted a plurality of sealing levers 6 which are arranged side-by-side as viewed transversely to the length dimension of the casting nozzle 3. Each sealing lever 6 is formed of two ceramic components bonded to one another, namely a setting arm 7 and a cylindrical pivotal joint part 8 which, with the aid of a filler component 9, is pivotally supported in a cylindrical, cradle-like bearing 10 of the casting nozzle 3. The pivotal axis of each sealing lever 6 is designated at 6′.

The setting arm 7 has, above the cylindrical joint part 8, an angled sealing extension 7′ which forms a sealing edge (or sealing face) 7″. The setting arm 7 is supported on the outer face of the casting nozzle 3 by means of a tungsten coil spring 11 which is situated upstream of the cylindrical joint part 8 as viewed in the direction of casting 4. The bias of the coil spring 11 is so selected that the sealing force generated at the sealing edge 7″ prevents entry of steel melt into the zone of the setting arm 7. Any fluctuations of the casting belt 1 in a direction perpendicular to the longitudinal nozzle axis 3′ is followed by the sealing lever 6 as urged by the spring 11.

The space 12 which accommodates the coil spring 11 and which is situated between the components 7, 8 and 3 is separated from the environment by a seal formed of a sealing plate 13 and a counter face 14. The sealing plate 13 mounted on the setting arm 7 slidably engages the counter face 14 affixed to the casting nozzle 3. A conduit 15 provided in the wall of the casting nozzle 3 opens into the chamber 12 to introduce a protective gas thereinto for ensuring that the tungsten coil spring 11 remains operational even at high environmental temperatures in excess of 1300° C.

Externally of the chamber 12 the setting arm 7 is, up to the sealing extension 7', embedded in a layer of granulated material 16 of magnesium oxide which is bounded from the front (that is, at left, as viewed in FIG. 1) by the wall of the casting nozzle 3 and a sealing block 17 made of a ceramic fiber material. The size of the granules of the granulated layer 16—which is intended to prevent deep penetration of the steel melt into the zone in front of the sealing levers 6 in case of malfunctioning—is so selected that the granules cannot be entrained in the casting direction 4 past the sealing lever 6.

The use of the cylindrical joint part 8 is advantageous in that the sealing levers 6 may be also set themselves by shifting in a direction perpendicular to FIG. 1 and can sealing engage the laterally adjoining lateral dam 2. In case the clearance between adjoining sealing levers 6 is maintained relatively small (in case of casting steel it is maintained smaller than approximately 0.2 mm), a particular seal for the clearance is not required. If need be, a sufficient sealing effect may be achieved by inserting a yielding ceramic fiber material between the sealing levers 6. A further or additional possibility for providing a seal between two adjoining sealing levers 6 comprises the introduction of an inert gas as protective gas. In particular, the protective gas introduced in the conduit 15 may be simultaneously utilized for the purpose of providing a seal between adjoining sealing levers 6.

The lateral seal between the casting nozzle 3 and the one and the other lateral dam 2 is effected on the one hand—as noted before—by the lateral engagement of the sealing lever 6 with the respective dam 2 and, on the other hand, by means of sealing strips 18 which—supported on tungsten springs 19—are held in depressions 20 of the casting nozzle 3 and are movable in the direction of the double-headed arrow 21. The sealing strips 18 made of a ceramic material extend up to the zone of the outermost sealing levers 6 while forming a cylindrical recess 18' which supports the cylindrical pivotal part 8. The sealing strips 18, while forming sealed locations, change over to the outermost sealing lever 6, so that the intermediate space between the casting nozzle 3 and the lateral dams 2 is sealed along the entire height between the casting belts 1. The tungsten springs 19 are expendiently connected to a protective gas source by means of a conduit (not shown).

Figure 3:
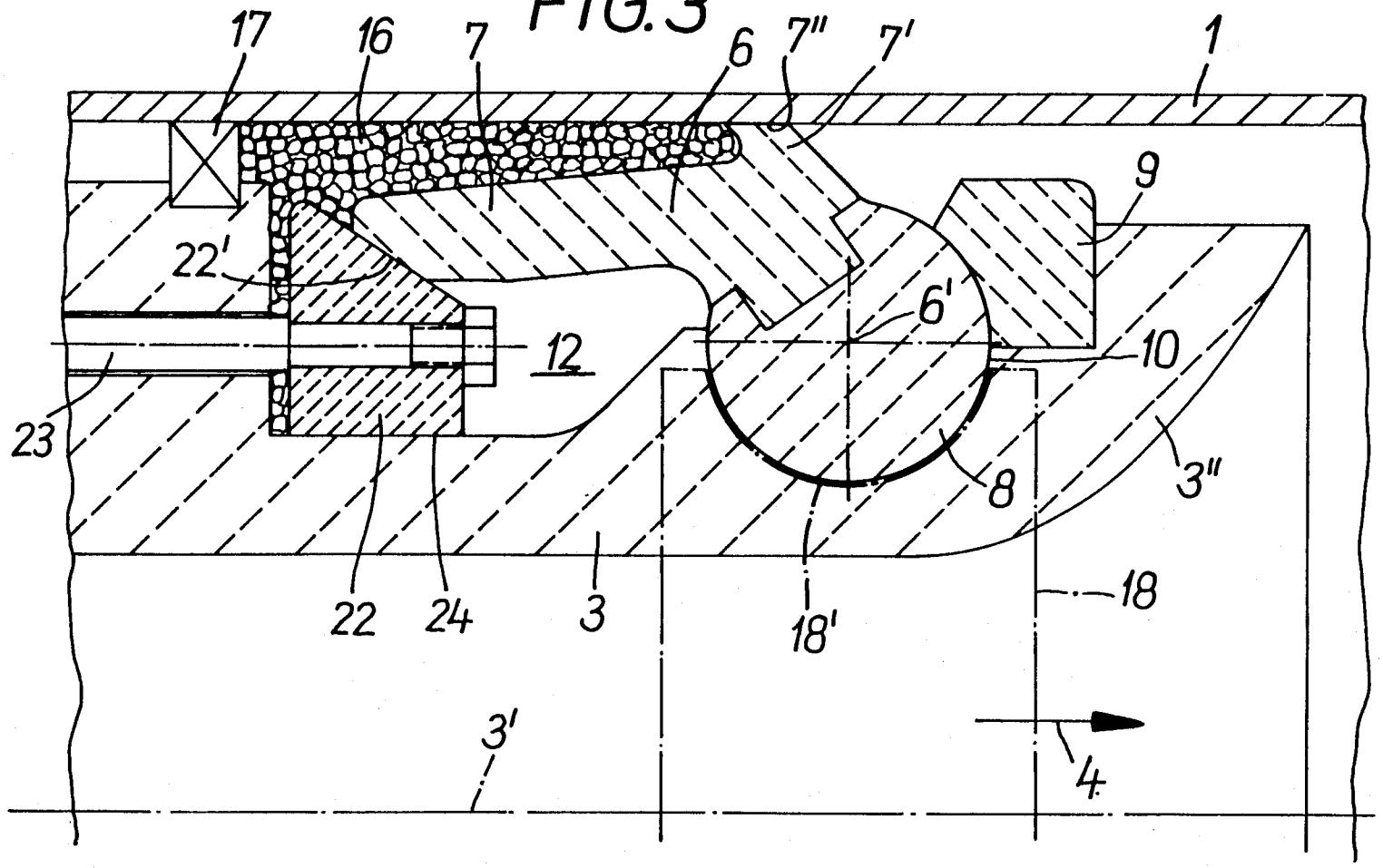
FIG. 3 is an axial sectional view of one symmetrical half of another preferred embodiment of the invention.

The embodiment illustrated in FIG. 3 relates to a substitute arrangement for the tungsten springs 11 (forming part of the embodiment shown in FIG. 1) particularly in case of high environmental temperatures. The embodiment shown in FIG. 3 is, for the resilient support of the sealing lever 6, provided with a shifter wedge 22 whose wedge face 22' supports the setting arm 7 of the sealing lever 6. The shifter wedge 22 is affixed, with the intermediary of a shifter rod 23, to a biased spring element (not shown) which—viewed in the casting direction 4—is situated at a substantial distance upstream of the shown zone of high environmental temperature. The spring element exerts a pushing force on the shifter rod 23, whereby the wedge face 22' urges the setting arm 7 upwardly. The shifter wedge 22 is supported on a slide face 24 which forms part of the casting nozzle 3 and which extends parallel to nozzle axis 3'. The use of the shifter rod 23 is advantageous not only because no protective gas is needed for the spring element due to its arrangement in lower environmental temperatures, but also because the sealing force derived from the shifter wedge 22 may be altered from the outside by varying the bias of the spring element.

Figure 4A:
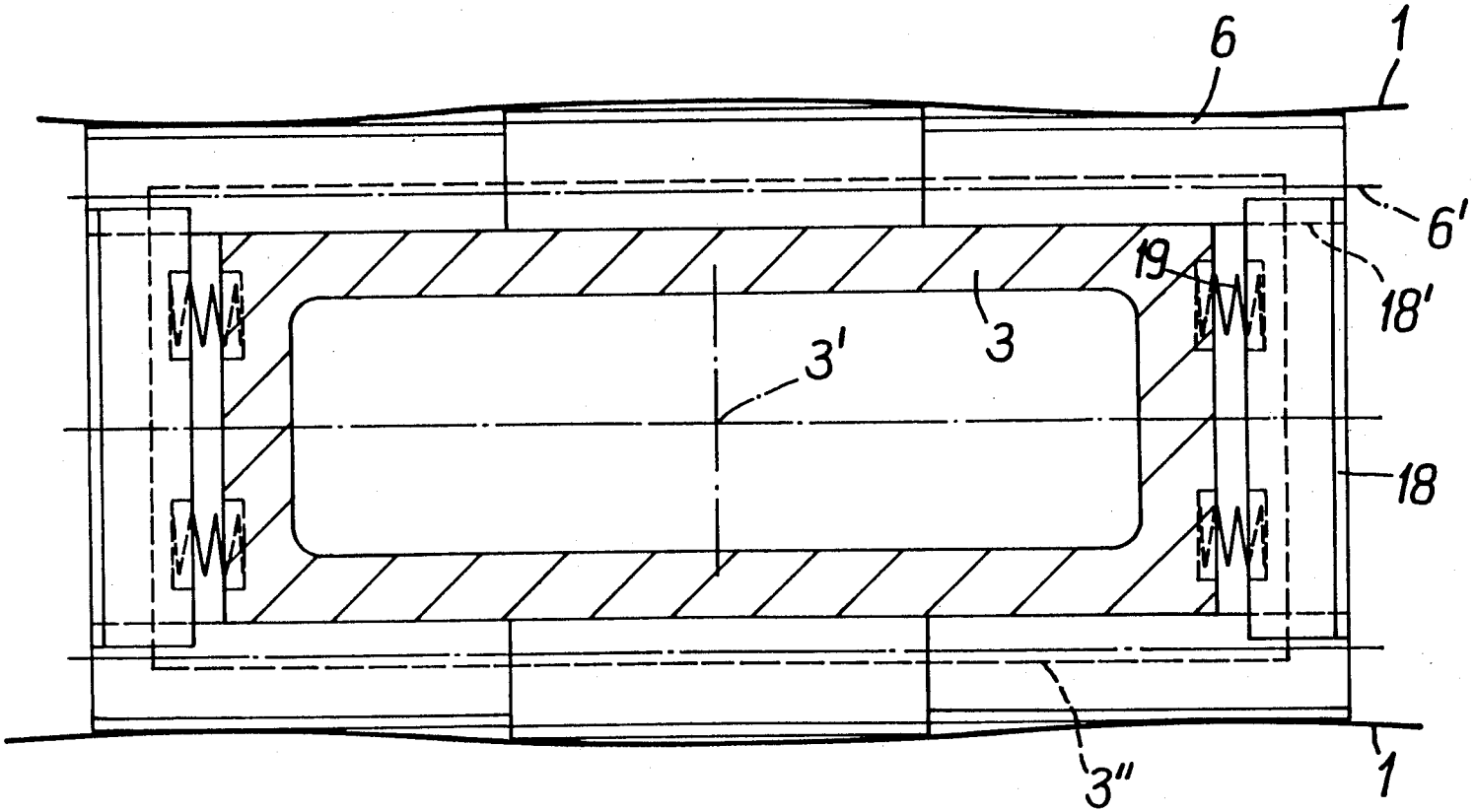
FIG. 4*a* is a sectional view of the preferred embodiments, taken in a plane perpendicular to the longitudinal axis.
Figure 4B:
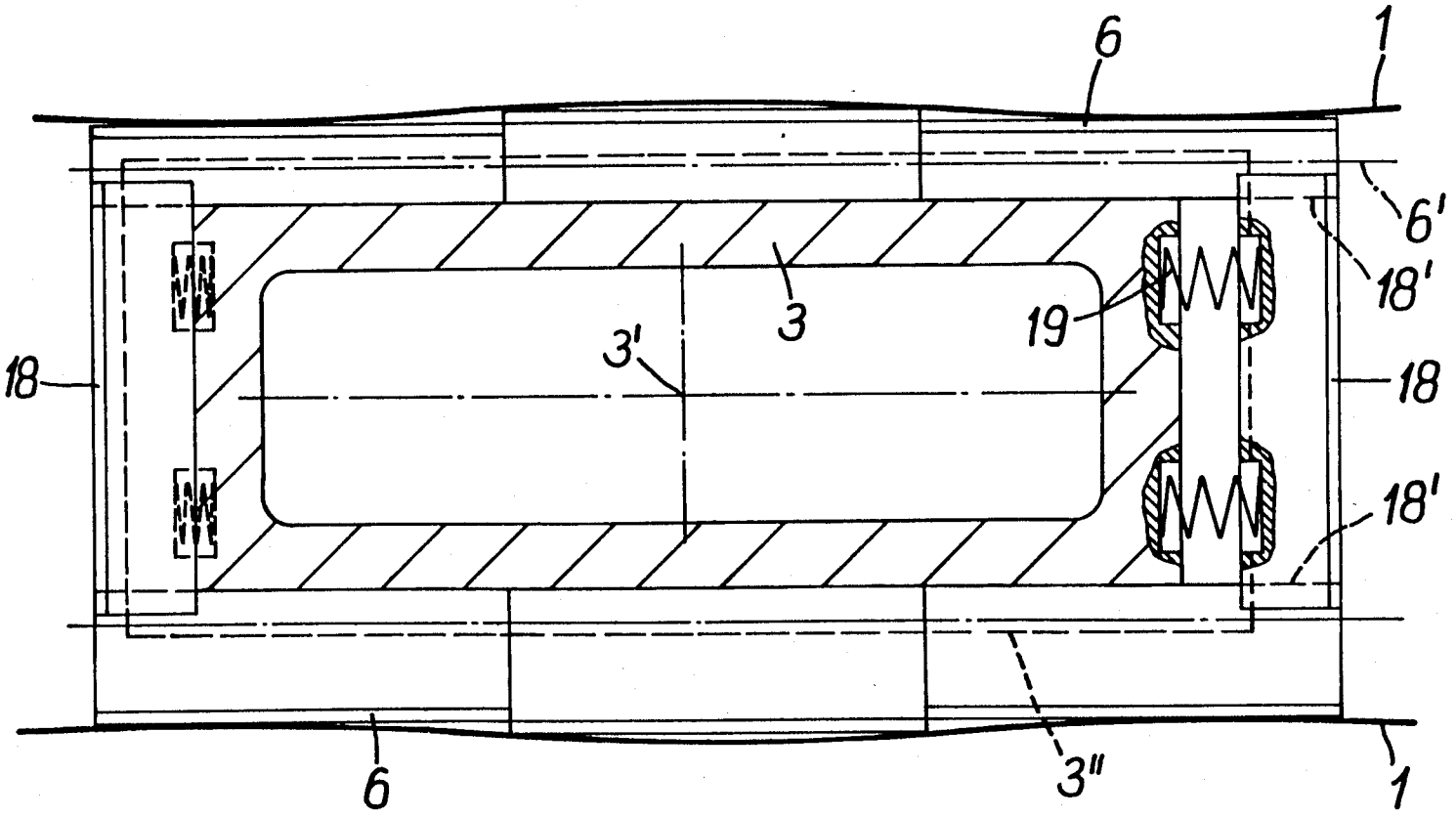
FIG. 4*b* is a view similar to FIG. 4*a*, showing one component in a shifted position.

Also referring now to FIGS. 4*a* and 4*b*, a preferred embodiment of the seal according to the invention comprises three side-by-side arranged movable sealing levers 6 which engage the respective upper and lower casting belt 1 as well as laterally arranged sealing strips 18 which, together with the lateral face of the two flanking sealing levers 6, sealingly engage the lateral dams 2 (not shown in FIG. 4*a*).

The inlet cross section of the casting nozzle 3 is, in the shown example, 30×120 mm, the outlet cross section is 76×166 mm and the casting cross section bounded by the mold walls 1 and 2 is 80×170 mm. The pivotal axes 6' of the sealing levers 6 situated on diametrically opposite sides of the casting nozzle are at a distance of 76 mm from one another.

As shown in FIG. 4*a*, by using a plurality of side-by-side situated sealing levers 6, the seal as a whole can be adapted to a wavy configuration of the sealing belts 1. Further, even a lateral shift of the casting nozzle 3 with respect to the mold walls 1 and 2 (as seen in FIG. 4*b*) does not lead to a deterioration of the sealing effect of the seal according to the invention. This is so because the sealing levers 6 are pivotal about their pivotal axes 6' and are thereby adaptable in height and they furthermore are laterally shiftable along their pivotal axis. Also, the sealing strips 18 may shift to a substantial extent under the effect of the tungsten springs 19 without losing contact with the associated lateral dam 2.

The shift towards the left of the casting nozzle 3 as shown in FIG. 4*b* has the result that the sealing levers 6 and the right-hand sealing strip 18 are shifted towards the right and the pivotal position of the sealing levers 6 is adapted automatically to the course of the associated cast belt 1.

The advantage achieved by the invention resides particularly in that the problem of providing a seal between the casting nozzle 3 and the movable mold walls 1 and 2 may be reduced to the more easily resolvable problem of sealing the clearance particularly between the sealing levers. The use of an essentially mechanically yielding seal makes possible an automatic equalization of a height and lateral shift between the distributor vessel arranged upstream of the mold and the mold itself during the casting operation without adversely affecting the sealing effect and thus facilitates the introduction of pre-heated casting nozzle as well as the starting of the casting apparatus. The shocks caused by the cast strand do not lead to a damaging of the casting nozzle because such shocks are taken up by the resilient sealing elements in the same way as are deformations which appear. The invention further makes possible to adapt the individual sealing elements to the requirements as regards their properties, by an appropriate choice of material. Since the sealing elements are maintained at all times with a spring force on the mold walls, the invention—independently from the casting speed—is effective during standstill as well and may therefore find application in casters of different construction.

For the sealing levers 6, the sealing strips 18 and the filler parts 17 shown in FIGS. 1 and 3 particularly hydraulically compressed alumina with approximately 60% $Al_2O_3$, 7% C and approximately 33% $SiO_2$ is considered. The casting belts 1 and the laterally arranged dams 2 are formed expediently of a low carbon-containing carbon steel having approximately 0.1% carbon or of a hardened Corson bronze having approximately 97.4%, Cu, 0.4% Si, 2% Ni and 0.2% Ti.

The casting nozzle is preferably an isostatically pressed rectangular tube which is of a material which consists of 50% $Al_2O_3$, 20% $SiO_2$ and 30 carbon and which received a finishing treatment with diamond grinders in a baked state.

It will be understood that the above description of the present invention is susceptible to various modifications, changes and adaptations, and the same are intended to be comprehended within the meaning and range of equivalents of the appended claims.

What is claimed is:

1. In a continuous steel casting apparatus including a casting nozzle having a longitudinal axis being parallel to a casting direction and an opening oriented in the casting direction; a mold surrounding the casting nozzle and extending therebeyond; said mold having moving mold walls formed of oppositely located, parallel-extending endless first and second casting belts having a width measured transversely to said casting direction; and oppositely located, parallel-extending endless first and second lateral dams; said casting belts and said dams together defining a rectangular casting cross section; the improvement comprising a sealing assembly providing a seal between the casting nozzle and the mold walls; said sealing assembly including at least one sealing lever situated between said casting nozzle and said first casting belt and at least one sealing lever situated between said casting nozzle and said second casting belt; means for movably mounting each said sealing lever on said casting nozzle; each said sealing lever having a sealing face oriented towards a respective said casting belt and extending parallel to the width thereof; and resilient means for resiliently urging each said sealing lever towards the respective said casting belt for maintaining a sealing engagement of said sealing face with the casting belts; said sealing levers having side surfaces; one of said side surfaces being in sealing engagement with said first dam and another of said side surfaces being in sealing engagement with said second dam.

2. A continuous steel casting apparatus as defined in claim 1, further comprising a first sealing strip extending between said casting nozzle and said first dam and a second sealing strip extending between said casting nozzle and said second dam; said first and second sealing strips being substantially perpendicular to said first and second casting belts and parallel to said first and second dams; said first and second sealing strips being supported on said casting nozzle; further comprising additional resilient means for resiliently urging said first and second sealing strips into a sealing engagement with said first and second dams, respectively.

3. A continuous steel casting apparatus as defined in claim 1, wherein there are provided a plurality of side-by-side arranged sealing levers along the width of the respective casting belts; said side-by-side arranged sealing levers having a lateral clearance of 0.2 mm at the most in case of a superheating of steel melt up to 80° C.

4. A continuous steel casting apparatus as defined in claim 1, wherein at least one of said sealing levers comprises a setting arm; said resilient means being arranged between and being in contact with said casting nozzle and said setting arm.

5. A continuous steel casting apparatus as defined in claim 4, further comprising a chamber defined together by said casting nozzle and said setting arm; said resilient means comprising a spring accommodated in said chamber; and means for sealing said chamber from the environment within said mold.

6. A continuous steel casting apparatus as defined in claim 5, wherein said spring is of tungsten; further comprising a conduit communicating with said chamber for introducing a protective gas into said chamber.

7. A continuous steel casting apparatus as defined in claim 1, further comprising a chamber situated upstream of said sealing face as viewed in the casting direction; said chamber being defined together by said casting nozzle, said sealing lever and a respective said casting belt; said chamber being charged with granulated material being resistant to steel melt.

8. A continuous steel casting apparatus as defined in claim 7, wherein said granulated material is magnesium oxide.

9. A continuous steel casting apparatus as defined in claim 1, wherein said means of movable mounting comprises a cylindrical joint having a cylinder axis extending transversely to said casting direction; said cylindrical joint forming part of the sealing lever and a cylindrical bearing affixed to said casting nozzle and receiving said cylindrical joint; said sealing lever being pivotal about said cylinder axis.

10. A continuous steel casting apparatus as defined in claim 9, further comprising a first sealing strip extending between said casting nozzle and said first dam and a second sealing strip extending between said casting nozzle and said second dam; said first and second sealing strips being substantially perpendicular to said first and second casting belts and parallel to said first and second dams; said first and second sealing strips being supported on said casting nozzle; further comprising additional resilient means for resiliently urging said first and second sealing strips into a sealing engagement with said first and second dams, respectively; each said sealing strip having end portions oriented towards respective sealing levers; each said end portion having a recess conforming to and receiving a respective said cylindrical joint.

11. A continuous steel casting apparatus as defined in claim 9, further wherein said cylindrical joint being slidable in said cylindrical bearing parallel to said cylinder axis.

* * * * *